US005972040A

United States Patent [19]

Moss et al.

[11] Patent Number: 5,972,040

[45] **Date of Patent: *Oct. 26, 1999**

[54] DETERGENT COMPOSITIONS CONTAINING PERCARBONATE AND AMYLASE

[75] Inventors: Michael Alan John Moss, Prudhoe; Christiaan Arthur Thoen, Tyne & Wear, both of United Kingdom

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/649,605

[22] PCT Filed: Dec. 15, 1994

[86] PCT No.: PCT/US94/14294

§ 371 Date: May 24, 1996

§ 102(e) Date: May 24, 1996

[87] PCT Pub. No.: WO95/17495

PCT Pub. Date: Jun. 29, 1995

[30] Foreign Application Priority Data

| | | | |
|---|---|---|---|
| Dec. 21, 1993 | [EP] | European Pat. Off. | 93203611 |
| Mar. 4, 1994 | [EP] | European Pat. Off. | 94870041 |

[51] Int. Cl.[6] ..... C11D 3/386; C11D 3/395

[52] U.S. Cl. ..... 8/137; 510/224; 510/226; 510/300; 510/305; 510/306; 510/309; 510/320; 510/392; 510/374; 510/375; 510/530; 8/401

[58] Field of Search ..... 510/224, 226, 510/300, 305, 306, 309, 320, 392, 530, 374, 375; 8/137, 401

[56] References Cited

U.S. PATENT DOCUMENTS

| | | | |
|---|---|---|---|
| 3,789,001 | 1/1974 | Painelli | 252/99 |
| 4,381,247 | 4/1983 | Nakagawa et al. . | |
| 4,526,698 | 7/1985 | Kuroda et al. | 252/99 |
| 4,620,936 | 11/1986 | Kielman et al. | 252/99 |
| 4,969,927 | 11/1990 | Schumann et al. | 8/159 |
| 5,219,549 | 6/1993 | Onda et al. | 423/415 |
| 5,223,179 | 6/1993 | Connor et al. | 252/548 |
| 5,227,084 | 7/1993 | Martens | 252/95 |
| 5,246,612 | 9/1993 | VanDijk et al. | 252/102 |
| 5,312,698 | 5/1994 | Onda et al. | 252/99 |
| 5,318,714 | 6/1994 | Markussen et al. | 252/95 |
| 5,318,728 | 6/1994 | Surutzidis et al. | 252/548 |
| 5,338,491 | 8/1994 | Connor et al. | 252/548 |
| 5,614,484 | 3/1997 | Panadiker | 510/102 |
| 5,635,104 | 6/1997 | Kott et al. | 252/186.1 |
| 5,705,466 | 1/1998 | Baillely | 510/312 |
| 5,786,314 | 7/1998 | Sadlowski | 510/230 |

FOREIGN PATENT DOCUMENTS

| | | | |
|---|---|---|---|
| 0504091 | 9/1992 | European Pat. Off. . | |
| 504091 | 9/1992 | European Pat. Off. | C11D 3/00 |
| 634478 | 1/1995 | European Pat. Off. | C11D 3/39 |
| 1940654 | 8/1969 | Germany . | |
| 1355855 | 6/1974 | United Kingdom . | |
| WO 94/03574 | 2/1994 | WIPO | C11D 3/12 |

*Primary Examiner*—Kery Fries
*Attorney, Agent, or Firm*—C. Brant Cook; Kim William Zerby; Jacobus C. Rasser

[57] ABSTRACT

A granular detergent composition comprising an alkali metal percarbonate and an amylase enzyme, characterized in that said composition contains an amylase in a weight ratio of percarbonate to amylase of 1:2 to 300:1, preferably 1:2 to 60:1, more preferably 20:1 to 40:1. Both laundry detergent compositions including laundry additives and automatic dishwashing compositions are encompassed by the term "detergent composition" herein. Methods of treatment of specific stains are also encompassed.

19 Claims, No Drawings

DETERGENT COMPOSITIONS CONTAINING PERCARBONATE AND AMYLASE

TECHNICAL FIELD

The present invention relates to detergent compositions containing percarbonate bleach, and amylase enzyme at narrowly defined ratios, to provide synergistic stain removal performance, in particular on specific stains such as starch-based stains, and blood stains.

BACKGROUND OF THE INVENTION

The inorganic perhydrate bleach most widely used in laundry detergent compositions is sodium perborate in the form of either the monohydrate or tetrahydrate. However, concerns about the impact of boron salts on the environment have led to an increasing interest in other perhydrate salts, of which sodium percarbonate is the most readily available.

Detergent compositions containing sodium percarbonate are known in the art. Sodium percarbonate is an attractive perhydrate for use in detergent compositions because it dissolves readily in water, is weight efficient and, after giving up its available oxygen, provides a useful source of carbonate ions for detergency purposes.

On the other hand, the use of amylase enzymes in detergent compositions is known, although such use has been mainly described in perborate-based formulations.

The use of enzymes, including amylase in percarbonate-based compositions is known from e.g. JP 57028197; PCT/US93/06302 and PCT/US93/06877.

Although the action of amylase on starch-based stains in particular, is known, and the action of percarbonate on bleacheable stains is also known, it has now been surprisingly discovered that the combined use of percarbonate and amylase at specific ratios provides a synergetic effect on the removal of difficult stains such as starch-based stains and blood stains, in particular at low temperatures.

In addition such a synergetic removal effect is also seen on particulate stains such as peat clay, mud, fertilizing soil, high organic content clay.

It has further been found that the ternary system consisting of percarbonate/amylase/protease at specific ratios provides an even better result on the above stains, in particular on starch-based and blood stains.

DETAILED DESCRIPTION OF THE INVENTION

Both laundry detergent compositions including laundry additives and automatic dishwashing compositions are encompassed by the term "detergent compositions" herein. Methods of treatment of textile are also encompassed.

Percarbonate

The laundry detergent or automatic dishwashing compositions herein typically contain from 1% to 40%, preferably from 3% to 30% by weight, most preferably from 5% to 25% by weight of an alkali metal percarbonate bleach (when expressed on an AvOx basis of 13.5%) in the form of particles having a mean size from 250 to 900 micrometers, preferably 500 to 700 micrometers.

Laundry additives typically contain from 20% to 80% of said percarbonate particles.

The alkali metal percarbonate bleach is usually in the form of the sodium salt. Sodium percarbonate is an addition compound having a formula corresponding to $2Na_2CO_3$ $3H_2O_{hd\ 2}$. To enhance storage stability the percarbonate bleach can be coated with e.g. a further mixed salt of an alkali metal sulphate and carbonate. Such coatings together with coating processes have previously been described in GB-1,466,799, granted to Interox on Mar. 9, 1977. The weight ratio of the mixed salt coating material to percarbonate lies in the range from 1:2000 to 1:4, more preferably from 1:99 to 1:9, and most preferably from 1:49 to 1:19. Preferably, the mixed salt is of sodium sulphate and sodium carbonate which has the general formula Na2SO4.n.Na2CO3 wherein n is from 0.1 to 3, preferably n is from 0.3 to 1.0 and most preferably n is from 0.2 to 0.5.

Other suitable coating materials are sodium silicate, of $SiO_2$:$Na_2O$ ratio from 1.6:1 to 2.8:1, and magnesium silicate.

Commercially available carbonate/sulphate coated percarbonate bleach may include a low level of a heavy metal sequestrant such as EDTA, 1-hydroxyethylidene 1,1-diphosphonic acid (HEDP) or an aminophosphonate, that is incorporated during the manufacturing process.

Preferred heavy metal sequestrants for incorporation as described herein above include the organic phosphonates and amino alkylene poly(alkylene phosphonates) such as the alkali metal ethane 1-hydroxy diphosphonates, the nitrilo trimethylene phsphonates, the ethylene diamine tetra methylene phosphonates and the diethylene triamine penta methylene phosphonates.

Amylase

The compositions herein further comprise as an essential ingredient an amylase enzyme (expressed on an activity of about 60 KNU/g) in a weight ratio with percarbonate (expressed on an activity basis of 13.5% AvOx) of 1:2 to 300:1, preferably 1:2 to 200:1.

An even more preferred ratio is 1:2 to 60:1 while the most preferred ratio is 20:1 to 40:1.

Preferred amylases include, for example, &-amylases obtained from a special strain of *B. licheniforms,* described in more detail in GB-1,296,839 (Novo Nordisk). Preferred commercially available amylases include for example, Rapidase, sold by International Bio-Synthetics Inc. and Termamyl, sold by Novo Nordisk A/S. The compositions preferably comprise, by weight, from 0.5% to 2%, more preferably from 0.1% to 1%, amylase.

Optional protease

In a preferred embodiment of the present invention, the detergent compositions herein also contain a protease enzyme. (expressed on an activity of about 4 KNPU/g) in a weight ratio of protease to percarbonate (expressed on an activity basis of 13.5% AvOx) of from 5:1 to 1:60, preferably 2:1 to 1:10.

Preferred commercially available protease enzymes include those sold under the trade names Alcalase and Savinase by Novo Nordisk A/S (Denmark) and Maxatase by International Bio-Synthetics, Inc. (The Netherlands).

In one embodiment of the present invention, the laundry detergent compositions herein also comprise a surface-active agent and a builder.

Surface Active Agent

Anionic Surfactants

The detergent compositions of the present invention usually contain one or more anionic surfactants as described below.

Alkyl Sulfate Surfactant

Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quarternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other Anionic Surfactants

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ehtylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch) . A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred surfactants for use in the compositions herein are the alkyl sulfates, alkyl alkoxylated sulfates, and mixtures thereof.

When included therein, the laundry detergent compositions of the present invention typically comprise from about 1% to about 40%, preferably from about 3% to about 20% by weight of such anionic surfactants.

Nonionic Surfactants

The present laundry detergent compositions preferably also comprise a nonionic surfactant.

While any nonionic surfactant may be normally employed in the present invention, two families of nonionics have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactants wherein at least one nonionic surfactant is selected from each of the groups of alkoxylated alcohols and the polyhydroxy fatty acid amides.

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 moles of ethylene oxide per mole of alcohol.

The nonionic surfactant system herein can also include a polyhydroxy fatty acid amide component.

Polyhydroxy fatty acid amides may be produced by reacting a fatty acid ester and an N-alkyl polyhydroxy amine. The preferred amine for use in the present invention is N-(R1)-CH2(CH2OH)4-CH2-OH and the preferred ester is a $C_{12}$–$C_{20}$ fatty acid methyl ester. Most preferred is the reaction product of N-methyl glucamine with $C_{12}$–$C_{20}$ fatty acid methyl ester.

Methods of manufacturing polyhydroxy fatty acid amides have been described in WO 92 6073, published on Apr. 16, 1992. This application describes the preparation of polyhydroxy fatty acid amides in the presence of solvents. In a highly preferred embodiment of the invention N-methyl glucamine is reacted with a $C_{12}$–$C_{20}$ methyl ester. It also says that the formulator of granular detergent compositions may find it convenient to run the amidation reaction in the presence of solvents which comprise alkoxylated, especially ethoxylated (EO 3–8) $C_{12}$–$C_{14}$ alcohols (page 15, lines 22–27). This directly yields nonionic surfactant systems which are preferred in the present invention, such as those comprising N-methyl glucamide and $C_{12}$–$C_{14}$ alcohols with an average of 3 ethoxylate groups per molecule.

Nonionic surfactant systems, and granular detergents made from such systems have been described in WO 92 6160, published on Apr. 16, 1992. This application describes (example 15) a granular detergent composition prepared by fine dispersion mixing in an Eirich RV02 mixer which comprises N-methyl glucamide (10%), nonionic surfactant (10%).

Both of these patent applications describe nonionic surfactant systems together with suitable manufacturing processes for their synthesis, which have been found to be suitable for use in the present invention.

The polyhydroxy fatty acid amide may be present in compositions of the present invention at a level of from 0% to 50% by weight of the detergent component or composition, preferably from 5% to 40% by weight, even more preferably from 10% to 30% by weight.

Other Surfactants

The laundry detergent compositions of the present invention may also contain cationic, ampholytic, zwitterionic, and semi-polar surfactants, as well as nonionic surfactants other than those already described herein, including the semi-polar nonionic amine oxides described below.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(0R^3)y][R^4(OR^3)y]_2R^5N+X-$$

wherein R2 is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2COH$—$CHOHCOR^6CHOHCH_2OH$ wherein R6 is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

When included therein, the laundry detergent compositions of the present invention typically comprise from 0% to about 25%, preferably from about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched chain. One of the aliphatic substituents contains at least 8 carbon atoms, typically from about 8 to about 18 carbon atoms, and at least one contains an anionic water-solubilizing group e.g. carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

When included therein, the laundry detergent compositions of the present invention typically comprise form 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivates of heterocyclic secondary and tertiary amines, or derivatives of quaternary ammonium, quarternary phosphonium or tertiary sulfonium compounds. See U.S. Pat. No. 3,929,678 to Laughlin et al., issued Dec. 30, 1975 at columns 19, line 38 through column 22, line 48 (herein incorporated by reference) for examples of zwitterionic surfactants.

When included therein, the laundry detergent compositions of the present invention typically comprise form 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydrocyalkyl groups containing form about 1 to about 3 carbon atoms; water-soluble phosphine oxides containing one alkyl moiety of form about 10 to about 18 carbon atoms and 2 moieties selected form the group consisting of alkyl groups and hydroxyalkyl groups containing from about 1 to about 3 carbon atoms.

Semi-polar nonionic detergent surfactants include the amine oxide surfactants having the formula:

$$R^3(OR^4)xN(R^5)2 \rightarrow O$$

Builder

The compositions herein preferably contain a builder, most preferably non-phosphate detergent builders. These can include, but are not restricted to alkali metal carbonates, bicarbonates, silicates, aluminosilicates, carboxylates and mixtures of any of the foregoing. The builder system is present in an amount of from 25% to 80% by weight of the composition, more preferably from 30% to 60% by weight.

Suitable silicates are those having an $SiO_2$:$Na_2O$ ratio in the range from 1.6 to 3.4, the so-called amorphous silicates of $SiO_2$:$Na_2O$ ratios from 2.0 to 2.8 being preferred.

Within the silicate class, highly preferred materials are crystalline layered sodium silicates of general formula $$NaMSi_xO_{2x}+1^{\cdot yH2O}$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2, 3 or 4 and is preferably 2. More preferably M is sodium and y is 0 and a preferred example of this formula comprise the form of $Na_2Si_2O_5$. These materials are available from Hoechst AG FRG as respectively NaSKS-5, NaSKS-7, NaSKS-11 and NaSKS-6. The most preferred material is —$Na_2Si_2O_5$, NaSKS-6. Crystalline layered silicates are incorporated either as dry mixed solids, or as solid components of agglomerates with other components.

Whilst a range of aluminosilicate ion exchange materials can be used, preferred sodium aluminosilicate zeolites have the unit cell formula $$Na_z[(AlO_2)_z\cdot(SiO_2)_y]\cdot xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2\cdot ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope.

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite X, P and MAP, the latter species being described in EPA 384070. In an especially preferred embodiment, the crystalline aluminosilicate ion exchange material is a Zeolite. A having the formula $$Na_{12}[(AlO_2)_{12}(SiO2)_{12}]\cdot xH_2O$$

wherein x is from about 20 to about 30, especially about 27 and has a particle size generally less than about 5 microns.

Suitable carboxylate builders containing one carboxy group include lactic acid, glycollic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German offenlegenschrift 2,446,686 and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829,1, and the 1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5,-tetrahydrofuran-tetracarboxylates, 1,2,3,4,5,6-hexane hexacarboxylates and carbxoymethyl derivatives of polyhydric alcohols such as sorbitol, mannitol and xylitol. Aromatic polycarboxylates include mellitic acid, pyromellitic acid and the phtalic acid derivates disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems useful in the present invention.

Density

The present compositions are preferably in a compact form, having a bulk density of at least 650 g/l, but can also be in a conventional form, with densities in a range of from 200 g/l to 700 g/l.

In another embodiment of the invention, are provided

Automatic Dishwashing Compositions:

Automatic dishwashing compositions typically contain, in addition to the percarbonate and silica of the inventions, a builder, such as described above, and a source of alkalinity, such as silicate or carbonate, those ingredients amounting to up to 70% of the formulation. Optional ingredients include polymers and enzymes.

In still another embodiment of the invention, are provided

Laundry Additive Compositions:

Such compositions typically contain in addition to the percarbonate and silica of the invention, a builder and a source of alkalinity.

Optional Ingredients

Other ingredients which are known for use in detergent compositions may also be used as optional ingredients in the various embodiments of the present invention, such as bleach activators, other bleaching agents, polymers, other enzymes, suds suppressing agents, as well as dyes, fillers, optical brighteners, pH adjusting agents, non builder alkalinity sources, enzyme stability agents, hydrotopes, perfumes.

Bleach activators

The present compositions, especially the laundry detergent compositions/additives, preferably contain from 1% to 20% by weight of the composition, preferably from 2% to 15% by weight, most preferably from 3 to 10 by weight of a peroxyacid bleach activator.

Peroxyacid bleach activators (bleach precursors) as additional bleaching components in accordance with the invention can be selected from a wide range of class and are preferably those containing one or more N- or O-acyl groups.

Suitable classes include anhydrides, esters, amides, and acylated derivatives of imidazoles and oximes, and examples of useful materials within these classes are disclosed in GB-A-1586789. The most preferred classes are esters such as are disclosed in GB-A-836 988, 864,798, 1 147 871 and 2 143 231 and amides such as are disclosed in GB-A-855 735 and 1 246 338.

Particularly preferred bleach activator compounds as additional bleaching components in accordance with the invention are the N-,N,N'N' tetra acetylated compounds of the formula

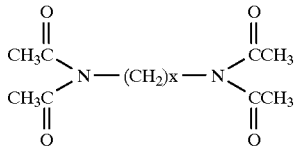

where x can be 0 or an integer between 1 and 6.

Examples include tetra acetyl methylene diamine (TAMD) in which x=1, tetra acetyl ethylene diamine (TAED) in which x=2 and Tetraacetyl hexylene diamine (TAHD) in which x=6. These and analogous compounds are described in GB-A-907 356. The most preferred peroxyacid bleach activator as an additional bleaching component is TAED.

Another preferred class of peroxyacid bleach compounds are the amide substituted compounds of the following general formulae

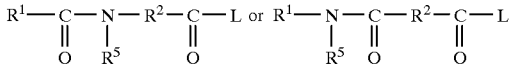

wherein $R^1$ is an aryl or alkaryl group with from about 1 to about 14 carbon atoms, $R^2$ is an alkylene, arylene, and alkarylene group containing from about 1 to about 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386.

Another class of bleach activators to use in combination with percarbonate comprises $C_8$, $C_9$, and/or $C_{10}$ (6-octanamidocaproyl) oxybenzenesulfonate, 2-phenyl-(4H)3,1 benzoxazin-4-one, benzoyllactam preferably benzoylcaprolactam and nonanoyl lactam preferably nonanoyl caprolactam.

In addition to percarbonate, the compositions herein may also contain another bleaching system such as perborate and activator, or a preformed organic peracid or perimidic acid, such as N,N phthaloylaminoperoxy caproic acid, 2-carboxyphtaloylaminoperoxy caproic acid, N,N phthaloylaminoperoxy valeric acid, Nonyl amide of peroxy adipic acid, 1,12 diperoxydodecanedoic acid, Peroxybenzoic acid and ring substituted peroxybenzoic acid, Monoperoxyphtalic acid (magnesium salt, hexhydrate), Diperoxybrassylic acid.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000. Also very useful are terpolymers of maleic/acrylic acid and vinyl alcohol having a molecular weight ranging from 3,000 to 70,000.

Polymeric polycarboxylate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Other useful polymers include species known as soil release polymers, such as described in EPA 185 427 and EPA 311 342.

Still other polymers suitable for use herein include dye transfer inhibition polymers such as polyvinylpyrrolidone, polyvinylpyrridine, N-oxide, N-vinylpyrrolidone, N-imidazole, polyvinyloxazolidone or polyvinylimidazole.

Other Enzymes

Enzymatic materials other than amylases and proteases can be incorporated into the detergent compositions herein. Suitable are lipases, cellulases and mixtures thereof.

A suitable lipase enzyme is manufactured and sold by Novo Nordisk A/S (Denmark) under the trade name Lipolase® and mentioned along with other suitable lipases in EP-A-0258068 (Novo Nordisk A/S).

Suitable cellulases are described in e.g. WO-92/13057 (Novo).

Method of treating textiles

It has been found that the binary and/or ternary mixtures described above provide unexpectedly good performance, through a synergistic removal effect on such difficult stains as starch-based stains and blood stains, even at low temperatures.

Starch-based stains include chocolate stains, as well as typical kitchen stains such as mayonnaise, mustard, icecream, dairy products.

Such stains are very difficult to remove at low temperature, and the present invention provides for a method of treating textiles at all temperatures, including at low temperature, wherein a detergent composition according to the above description is used.

The invention also encompasses a similar method for treating fabrics to remove blood stains and fabrics stained with stains rich in blood.

According to the invention, a synergistic removal effect of particulate stains is also seen. With "particulate stains" is meant for instance peat clay, mud, high organic content clay mainly found in socks, sportswear and the like.

Mucin or mucin-protein based stains include female secretions and handkerchief stains (bronchial mucus).

Such stains are very difficult to remove at low temperature, and the present invention provides for a method of treating textiles at all temperatures, including at low temperature, wherein a detergent composition according to the above description is used.

The method for treating fabrics is typically a laundry machine washing operation, and can be conducted by any method well known in the art; a particularly preferred method includes the use of a reusable dispensing device, in which the detergent composition is put before the washing cycle, and which is placed in the drum of the washing machine together with the clothes to be washed, before starting the washing machine.

The following granular detergent compositions are prepared:

| Composition: | I | II |
|---|---|---|
| 45AS | 11.0 | 14.0 |
| Zeolite A | 15.0 | 6.0 |
| Carbonate | 4.0 | 8.0 |
| Maleic acrylic copolymer | 4.0 | 2.0 |
| CMC | 0.5 | 0.5 |
| *DTPMA | 0.4 | 0.4 |
| AE5 | 5.0 | 5.0 |
| Perfume | 0.5 | 0.5 |
| SKS 6 | 13.0 | 10.0 |
| Citrate | 3.0 | 1.0 |
| TAED | 7.0 | 7.0 |
| Percarbonate (14.0% AvOx) | 20.0 | 20.0 |
| Soil release polymer | 0.3 | 0.3 |
| Savinase (4 KNPU) | 1.4 | 1.4 |
| Lipolase (100,000 LU) | 0.4 | 0.4 |
| Cellulase | 0.6 | 0.6 |
| Termamyl (60 KU) | 0.6 | 0.6 |
| Silicone antifoam particle | 5.0 | 5.0 |
| Brightener | 0.2 | 0.2 |

Density: 850 g/L
*DTPMA = Diethylenetriaminepentamethylene phosphonic acid.

| Composition | III | IV | V |
|---|---|---|---|
| Zeolite A | 15.0 | 15.0 | |
| Na2SO4 | 0.0 | 5.0 | |
| LAS | 3.0 | 3.0 | |
| DTPMA | 0.4 | 0.5 | |
| CMC | 0.4 | 0.4 | |
| Maleic acrylic copolymer | 4.0 | 4.0 | |
| 45AS | | | 11.0 |
| LAS | 6.0 | 5.0 | |
| TAS | 3.0 | 2.0 | |
| Na2 Silicate | 4.0 | 4.0 | |
| Zeolite A | 10.0 | 15.0 | 13.0 |
| CMC | | | 0.5 |
| Maleic acrylic copolymer | | | 2.0 |
| Na2 Carbonate | 9.0 | 7.0 | 7.0 |
| Perfume | 0.3 | 0.3 | 0.5 |
| AE7 | 4.0 | 4.0 | 4.0 |
| AE3 | 2.0 | 2.0 | 2.0 |
| Maleic acrylic copolymer | | | 3.0 |
| SKS 6 | | | 12.0 |
| Citrate | 10.0 | 0.0 | 8.0 |

-continued

| | | | |
|---|---|---|---|
| Na Bicarbonate | 7.0 | 3.0 | 5.0 |
| Na2 Carbonate | 8.0 | 5.0 | 7.0 |
| PVP | 0 | 0.5 | 0 |
| PVPVI | 0.2 | 0 | 0.25 |
| PVNO | 0.3 | 0 | 0.4 |
| Savinase (4.0 KNPU/g) | 1.0 | 1.0 | 1.30 |
| Lipolase (100.000 LU/L) | 0.4 | 0.4 | 0.4 |
| Amylase (Termamyl) 60 KNU/g | 0.5 | 0.6 | 0.6 |
| Carezyme | 0.6 | 0.5 | 0.6 |
| Silicone antifoam granule | 5.0 | 5.0 | 5.0 |
| Dry mixed Na2 Sulfate | 0.0 | 9.0 | 0.0 |
| Percarbonate | 0.1 | — | — |
| Balance (Moisture and Miscellaneous) | 100.0 | 100.0 | 100.0 |

Density: 700 g/L

| Composition: | VI | VII | VIII | IX | X | XI |
|---|---|---|---|---|---|---|
| Zeolite A | 15.0 | 15.0 | 15.0 | 15.0 | 15.0 | 15.0 |
| Na2SO4 | 0.0 | 5.0 | 0.0 | 0 | 0 | 0 |
| LAS | 3.0 | 3.0 | 3.0 | 3 | 3 | 3 |
| DTPMA | 0.4 | 0.4 | 0.4 | 0.4 | 0.4 | 0.4 |
| CMC | 0.4 | 0.4 | 0.4 | 0.4 | 0.3 | 0.3 |
| Maleic acrylic copolymer | 4.0 | 2.0 | 2.0 | 0 | 0 | 0 |
| Polyaspartate | 0 | 0 | 0 | 4 | 4 | 0 |
| Terpolymer maleic acid acrylic vinyl alcohol | 0 | 0 | 0 | 0 | 0 | 4 |
| LAS | 5.0 | 5.0 | 5.0 | 5 | 5 | 5 |
| TAS | 2.0 | 2.0 | 2.0 | 2 | 2 | 2 |
| Na2 Silicate | 3.0 | 3.0 | 4.0 | 4 | 4 | 4 |
| Zeolite A | 8.0 | 8.0 | 8 | 5 | 6 | 8 |
| Na2 Carbonate | 8.0 | 8.0 | 4.0 | 4 | 4 | 4 |
| Perfume | 0.3 | 0.3 | 0.3 | 0.3 | 0.3 | 0.3 |
| AE7 | 2.0 | 2.0 | 2.0 | 2.0 | 2 | 2 |
| AE3 | 2.0 | | | 2 | 2 | 2 |
| Na2 Citrate | 5.0 | 0.0 | 2.0 | 5 | 5 | 5 |
| Na Bicarbonate | | 3.0 | 0.0 | 0 | 0 | 0 |
| Na2 Carbonate | 8.0 | 15.0 | 10.0 | 8 | 8 | 8 |
| TAED | 6.0 | 2.0 | 5.0 | 5 | 5 | 5 |
| Percarbonate | 14 | 20.0 | 10.0 | 5 | 5 | 5 |
| Polyethylene oxide | | | 0.2 | 0 | 0 | 0 |
| Bentonite | | | 10.0 | 0 | 0 | 0 |
| Savinase (4.0 KNPU/g) | 1.0 | 1.0 | 1.0 | 1.0 | 1.0 | 1.0 |
| Lipolase (100.000 LU/L) | 0.4 | 0.4 | 0.4 | 0.4 | 0.4 | 0.4 |
| Amylase (Termamyl) 60 KNU/g | 0.6 | 0.5 | 0.6 | 0.6 | 0.4 | 0.4 |
| Carezyme | 0.6 | 0.6 | 0.6 | 0.6 | 0.3 | 0.2 |
| Silicone antifoam granule | 3.0 | 4.0 | 5 | 4 | 5 | 5 |
| Dry mixed Na2 Sulfate | 0.0 | 3.0 | 0.0 | 0 | 0 | 0 |
| Balance (Moisture and Miscellaneous) | 100.0 | 100.0 | 100.0 | 100.0 | 100.0 | 100.0 |

Density: 700–850 g/L

| Composition: | XII | XIII | XIV |
|---|---|---|---|
| Zeolite A | 30.0 | 22.0 | 6.0 |
| Na Sulfate | 19.0 | 10.0 | 7.0 |
| Maleic acrylic copolymer | 3.0 | 3.0 | 6.0 |
| LAS | 14.0 | 12.0 | 22.0 |
| 45AS | 8.0 | 7.0 | 7.0 |
| Na2 Silicate | | 1.0 | 5.0 |
| Soap | | | 2.0 |
| Brightener | 0.2 | 0.2 | 0.2 |
| Na2 Carbonate | 8.0 | 16.0 | 20.0 |
| DTPMA | | 0.4 | 0.4 |
| AE7 | 1.0 | 1.0 | 1.0 |
| PVPVI | 0.25 | 0 | 0.1 |
| PVNO | 0.2 | 0 | 0.2 |
| PVP | 0 | 0.5 | 0 |

-continued

| | | | |
|---|---|---|---|
| Savinase (4.0 KNPU/g) | 1.0 | 1.0 | 1.0 |
| Lipolase (100.000 LU/L) | 0.4 | 0.4 | 0.4 |
| Amylase (Termamyl) 60 KNU/g | 0.1 | 0.3 | 0.5 |
| NOBS | | 6.1 | 4.5 |
| Percarbonate | 1.0 | 3.0 | 3.0 |
| Dry mixed Na2 Sulfate | | 6.0 | |
| Balance/Miscellaneous | 100 | 100 | 100 |

Density: 500–600 g/L

EXAMPLES

EXAMPLE 1

Blood based stain removal
Launderometer test
2 g/l finished product
40° C./8° H water
40 minutes wash cycle

| STAIN TYPE | $PC_3$ | AMYLASE | % STAIN REMOVAL |
|---|---|---|---|
| Meat Pate | 14% | 0.5% | 80% |
| Meat Pate | — | 0.5% | 24% |
| Meat Pate | 14% | — | 45% |

EXAMPLE 2

Stain removal from chocolate ice cream
Conditions
Washing machine test
40° C./8° H Hard Water
2Kg mixed ballast load

| STAIN TYPE | PERCARBONATE | AMYLASE | % STAIN REMOVAL |
|---|---|---|---|
| Chocolate ice cream | 14.5% | — | 40% |
| Chocolate ice cream | — | 0.25% | 25% |
| Chocolate ice cream | 14.5% | 0.25% | 75% |

EXAMPLE 3

Blood based stain removal
Conditions
Sotax test
40° C./15° H Hard Water
40 minutes wash cycle
No ballast load

| STAIN TYPE | PERCARBONATE | AMYLASE | % STAIN REMOVAL |
|---|---|---|---|
| Beef stew | 18% | — | 40% |
| Beef stew | — | 0.6% | 20% |
| Beef stew | 18% | 0.6% | 77% |

EXAMPLE 4

Chocolate ice cream stain removal
Conditions
Launderometer
2 g/l product
40° C./8° H water
40 min. wash cycle

| Stain type | % Percarbonate | % amylase | % stain removal |
|---|---|---|---|
| Low fat choc ice cream with choc sauce | 19 | — | 35 |
| Low fat choc ice cream with choc sauce | — | 0.6 | 20 |
| Low fat choc ice cream with choc sauce | 19 | 0.6 | 70 |
| Low fat choc ice cream with choc sauce | 19 | 0.3 | 60 |
| Low fat choc ice cream with choc sauce | — | 0.3 | 15 |
| Low fat choc ice cream with choc sauce | 19 | 0.03 | 35 |
| Low fat choc ice cream with choc sauce | — | 0.03 | — |

EXAMPLE 5

Particulate stain removal
Conditions as mentioned under Example 4

| Stain type | % Percarbonate | % amylase | % stain removal |
|---|---|---|---|
| Peat clay | 19 | — | 25 |
| Peat clay | — | 0.6 | 35 |
| Peat clay | 19 | 0.6 | 75 |
| Peat clay | — | 0.03 | — |
| Peat clay | 19 | 0.03 | 25 |

In all of the above tests the measurements were made using a colour eye spectrophotometer.

The following formula was used to calculate stain removal:

$$\frac{\text{Washed stain - Unwashed stain}}{\text{Clean fabric - Unwashed fabric}} \times 100 = \text{\% stain removal}$$

(The standard LAB calculations were used in the above experiment)

The above clearly shows that the combined use of percarbonate and amylase provides a synergetic effect on the removal of difficult stains, such as blood stains and starch-based stains like chocolate and particulate stains like peat clay as well.

EXAMPLE 6

Chocolate ice cream stain removal
Conditions
Launderometer
amylase present at 0.1% in every testing
2 g/l product
40° C./8° H water
40 min wash cycle

| Stain type | % percarbonate | % perborate | % protease | % stain removal |
|---|---|---|---|---|
| Full cream ice cream and choc sauce | 20 | — | — | 30 |
| Full cream ice cream and | 20 | — | 20 | 70 |

-continued

| Stain type | % percarbonate | % perborate | % protease | % stain removal |
|---|---|---|---|---|
| choc sauce | | | | |
| Full cream ice cream and choc sauce | — | — | 20 | 20 |
| Full cream ice cream and choc sauce | 20 | — | 5 | 55 |
| Full cream ice cream and choc sauce | — | — | 5 | 15 |
| Full cream ice cream and choc sauce | 2.5 | 17.5 | 20 | 30 |
| Full cream ice cream and choc sauce | 2.5 | 17.5 | — | 10 |

What is claimed is:

1. A granular detergent composition comprising the following:

(a) 1% to 20% of an anionic surfactant mixture comprising alkyl sulfate, alkyl ethoxylated sulfate, and a linear alkyl benzene sulfonate;

(b) a nonionic surfactant which is an ethoxylated alcohol;

(c) an alkali metal percarbonate (expressed as 13.5% AvOx); and (d) an amylase enzyme (expressed on an activity of about 60 KNU/g where the weight ratio of percarbonate to amylase is in the range of 20:1 to 63.3:1.

2. A composition according to claim 1 wherein the weight ratio of percarbonate to amylase is from °20:1 to 40:1.

3. A composition in accordance with claim 1 wherein said percarbonate has an average particle size of from 250 to 900 micrometers.

4. A composition in accordance with claim 1 which contains a protease in a weight ratio protease (expressed on an activity of about 4 KNPU/g) to percarbonate (expressed as 13.5% AvOx) of from 5:1 to 1:60.

5. A composition according to claim 1 wherein the weight ratio of protease to percarbonate is from 2:1 to 1:10.

6. A composition in accordance with claim 1 which is a laundry detergent composition containing from about 1% to 20%, by weight, anionic surfactant, a builder, from 3% to 30%, by weight percarbonate and from 0.1% to 1%, by weight, amylase.

7. A composition in accordance with claim 1 which is an automatic dish washing composition containing a builder, from 3% to 30%, by weight, percarbonate and from 0.1% to 1%, by weight, amylase.

8. A composition according to claim 1 comprising from about 3% to 20%, by weight, anionic surfactant.

9. A composition according to claim 1 comprising from 1% to 20%, by weight, of a bleach activator selected from the group consisting of tetraacetyl methylene diamine, tetraacetyl ethylene diamine, tetraacetyl hexylene diamine, $C_8$-(6-octanamidocaproyl)oxybenzenesulfonate, $C_9$-(6-octanamidocaproyl)oxybenzenesulfonate, $C_{10}$-(6-octanamidocaproyl)oxybenzenesulfonate, 2-phenyl-(4H)3, 1 benzoxazin4-one, benzoyllactams, nonanoyl lactams and mixtures thereof.

10. A composition according to claim 9 further comprising a protease in a weight ratio of protease (expressed on an activity of about 4 KNPU/g) to percarbonate (expressed as 13.5% AvOx) of from 5:1 to 1:60.

11. A composition according to claim 1 further comprising a dye transfer inhibition polymer.

12. A composition according to claim 11 wherein the dye transfer inhibition polymer is selected from the group consisting of polyvinylpyrrolidones, polyvinylpyrridines, polyvinyloxazolidones, polyvinylimidazoles and mixtures thereof.

13. A composition according to claim 10 further comprising a dye transfer inhibition polymer.

14. A composition according to claim 13 wherein the dye transfer inhibition polymer is selected from the group consisting of polyvinylpyrrolidones, polyvinylpyrridines, polyvinyloxazolidones, polyvinylimidazoles and mixtures thereof.

15. A method for removing starch containing stains from textiles whereby said textiles are treated with a detergent composition according to claim 6.

16. A method for removing blood stains from textiles whereby said textiles are treated with a detergent composition according to claim 6.

17. A method for removing particulate stains from textiles whereby said textiles are treated with a detergent composition according to claim 6.

18. A method for removing mucin or mucin-protein containing stains from textiles whereby said textiles are treated with a detergent composition according to claim 6.

19. A method according to claim 15 whereby the detergent composition is put in a reusable dispensing device together with the clothes to be washed.

* * * * *